US005246127A

United States Patent [19]

Purcell

[11] Patent Number: 5,246,127

[45] Date of Patent: Sep. 21, 1993

[54] CLOSURE FOR A CONTAINER

[75] Inventor: Wade Purcell, Grand Island, N.Y.

[73] Assignee: Life Technologies, Inc., Gaithersburg, Md.

[21] Appl. No.: 923,497

[22] Filed: Aug. 3, 1992

[51] Int. Cl.[5] ..... B65D 41/00

[52] U.S. Cl. ..... 215/305; 215/303

[58] Field of Search ..... 215/305, 302, 303, 304, 215/329, 316, 298, 228; 220/286, 285, 284, 281, 260, 212.5, 254

[56] References Cited

U.S. PATENT DOCUMENTS

| | | | |
|---|---|---|---|
| 769,132 | 8/1904 | Graham | 215/316 |
| 1,031,775 | 7/1912 | Cox | 215/303 |
| 1,103,859 | 7/1914 | Austin | 220/260 X |
| 1,324,455 | 12/1919 | Lefevre | 220/285 |
| 1,837,376 | 12/1931 | Snyder | 215/298 |
| 2,120,603 | 6/1938 | Dreucci | 215/303 |
| 2,308,217 | 1/1943 | Swanson | 215/303 |
| 2,487,274 | 11/1949 | Schaffer | 215/304 X |
| 2,950,833 | 8/1960 | Short . | |
| 3,401,827 | 9/1968 | Messina | 220/212.5 |
| 3,419,198 | 12/1968 | Pettersen | 220/281 X |
| 3,945,526 | 3/1976 | Robertson, Jr. | 215/303 X |
| 4,276,993 | 7/1981 | Hasegawa | 220/269 |
| 4,881,668 | 11/1989 | Kitterman et al. . | |
| 4,955,513 | 9/1990 | Bennett . | |
| 5,054,663 | 10/1991 | Groya et al. . | |
| 5,085,331 | 2/1992 | Groya et al. . | |

FOREIGN PATENT DOCUMENTS

| | | | |
|---|---|---|---|
| 482836 | 7/1953 | Italy | 215/305 |

OTHER PUBLICATIONS

Aldrich Chemical Company, Catalog Handbook of Fine Chemicals, 1990, pp. 2010 and 2084.

Food & Drug Packaging, "*Large-orifice closure dispenses with convention*", Mar. 1989.

Sunbeam Plastics Corporation, Introducing CC-2 Dispensing Closures, No. SPC-M1001.

*Primary Examiner*—Allan N. Shoap
*Assistant Examiner*—Paul A. Schwarz
*Attorney, Agent, or Firm*—Sterne, Kessler, Goldstein & Fox

[57] ABSTRACT

The present invention is directed to a cap or closure for a container. The closure includes a top surface devoid of an opening, a downwardly extending apron arranged about the periphery of the top surface, and a grasping tab. The top surface and apron define therebetween an interior area which is adapted to receive the opening of a container. The grasping tab is hingedly attached to the top surface of the closure and is positionable between an extended condition and a stored condition. When the grasping tab is in the extended condition, the tab may be grasped between the fingers of the user's hand.

14 Claims, 7 Drawing Sheets

CLOSURE FOR A CONTAINER

FIELD OF THE INVENTION

The present invention is directed to a closure or cap for a container. More particularly, the present invention is a sterilizable closure for a sterilizable container which includes a grasping tab which may be grasped between the fingers of a user's hand.

BACKGROUND OF THE INVENTION

For many years, chemical solutions have been stored and mixed in sterilizable containers. These containers typically include stopper or screw-on closures which are held in the hand of the user (together with the container) to cut-down on contamination of the solution which would otherwise occur if the closure were to be placed on an unsterile surface. Although these closures have become quite common, they are often difficult to hold by those having relatively small hands and/or they require sterilization after each use.

Typical stopper closures (such as pennyhead stoppers available from Aldrich Chemical Company, Inc., product numbers Z10, Z11 or Z17) may be easily removed from a container and held between the fingers of a user. However, because the stopper portion of the closure is exposed to the air and later returned to the interior of the container, the stopper must be sterilized after each use to avoid contaminating the solution with bacteria which may have come into contact with the stopper portion of the closure. Moreover, stopper closures do not ensure absolute sealing of the container, as a stopper closure may become dislodged if the container were accidentally knocked over.

On the other hand, screw-on closures, which do not come into contact with the interior of a container, are screwed about the neck portion of a container to close the same. In order to avoid contamination of the closure (by placing the closure on an unsterile surface, for example), the user often holds the closure within the palm of the hand which is also holding the container. It may not be feasible to hold the closure in the other free hand, as the other hand is often needed for pipetting or to hold other containers. If the neck portion of the container is relatively large (which it usually is to allow introduction of instruments into the container), the closure is also large and therefore difficult to hold by those having relatively small hands. Thus, while it is desirable to provide a container with a large opening, it is undesirable to have a large closure therefor.

In an effort to solve this problem, large-orifice, flip-top closures have been developed. An example of such a closure is the 38-400 CC-2 manufactured by Sunbeam Plastics Corp., Evansville, Ind. The closure is a two-piece unit comprised of a threaded base and a hinged flip top. When the user wishes to pour the contents from the container, the flip top is simply opened and the contents of the container are poured therefrom. The closure unit is never removed from the container; thus, the closure is never held within the hand of the user and the risk of contamination is decreased. However, when a liquid is poured from the flip-top dispenser, the flow path of the liquid is interrupted and liquid spills down the outer surface of the closure and container. This spilled liquid may become contaminated with airborne bacteria and thereby contaminate the solution within the container. Therefore, to decrease contamination risks, the flip-top closure and the container must be sterilized after each use. Moreover, the internal structure of the flip-top may interfere with the introduction of instruments into the container. When inserting a pipette (for example) into a container, it is imperative that the pipette not touch any interior surface of the container or closure. Finally, manufacture of a two-piece, flip-top closure is relatively difficult.

Other flip-top closures are disclosed in U.S. Pat. Nos. 2,950,833, 4,881,668 and 5,085,331. The orifices of these closures, however, are relatively small and would obstruct or interfere with the introduction of instruments into the container.

Therefore, it is an object of the present invention to provide a closure for a container which does not obstruct the opening of the container.

Another object of the invention is to provide a closure for a container which may be easily held within the user's hand.

A further object of the invention is to provide a closure for a container which may be easily removed from the container.

Yet another object of the invention is to provide a closure for a container which does not interfere with storage or shelving of the container.

Still another object of the invention is to provide a closure for a container which is easily manufactured and sterilizable.

SUMMARY OF THE INVENTION

In accordance with the objects of the present invention as described and embodied herein, the present invention is a closure or cap for a container. In one aspect of the invention, the closure includes a top surface devoid of an opening, an apron which extends downwardly from the peripheral edge of the top surface, and a grasping tab. The top surface and apron define therebetween an interior area which is adapted to receive the opening of a container. The grasping tab is hingedly attached to the top of surface of the closure and is positionable between an extended condition and a stored condition.

In another aspect of the invention, the closure includes an uninterrupted top surface, a downwardly extending apron arranged about the periphery of the top surface, and a grasping tab. The top surface and the apron define therebetween an interior area which is adapted to receive the opening of a container. The grasping tab is attached to the top surface of the closure and is positionable between an extended condition and a stored condition. When the grasping tab is positioned in the extended condition, the grasping tab may be grasped between the fingers of a user.

The inner surface of the apron may be threaded to securingly mate with a correspondingly threaded container opening. The outer surface may be vertically ribbed to provide increased frictional engagement between the closure and the user's hand.

The closure may be further provided with a locking means for locking the grasping tab in the stored condition when the tab is not in use. The locking means may include a locking tab disposed on the top surface of the closure and a tab receiving opening defined by the grasping tab.

An indentation located in the apron of the closure may also be provided to assist in positioning the grasping tab in the extended position.

The closure is preferably formed from a plastic that may be sterilized by both gamma and autoclave methods.

BRIEF DESCRIPTION OF THE DRAWINGS

The foregoing and other aspects and features of the present invention will be more fully understood from the following detailed description of the present invention when considered in conjunction with the accompanying drawings, in which.

DESCRIPTION OF THE PREFERRED EMBODIMENT

Figure 1:
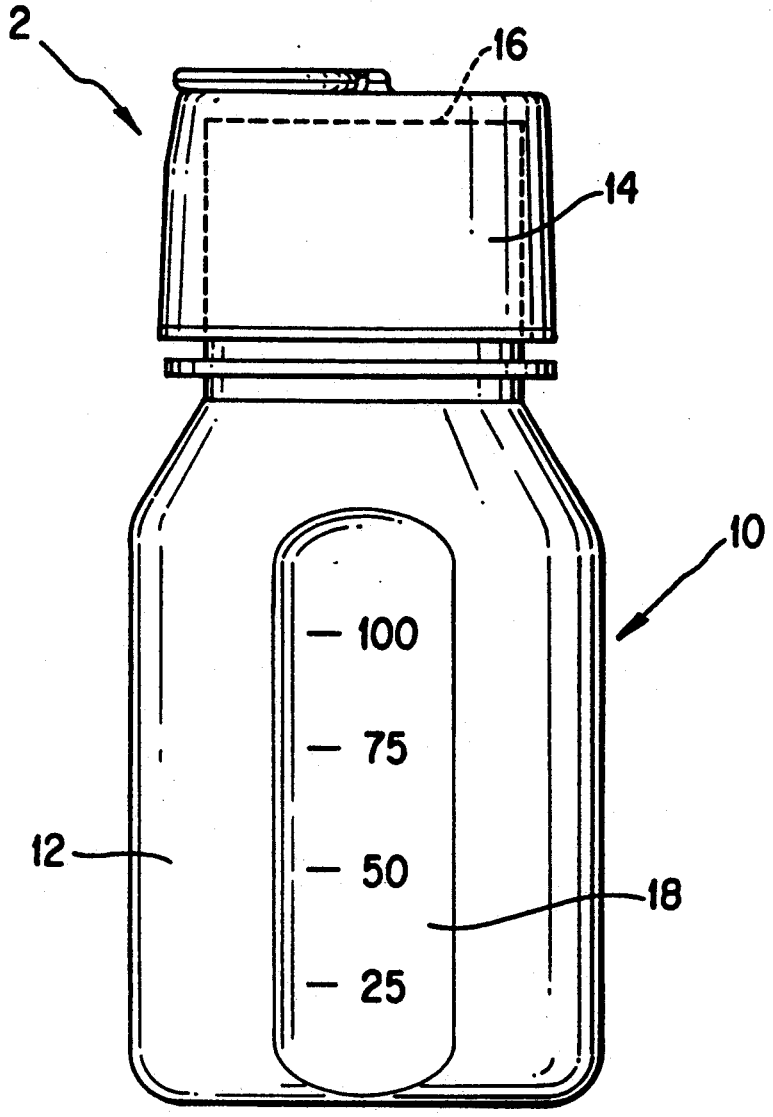
FIG. 1 illustrates the closure of the present invention disposed on a container.

With continuing reference to the drawing figures in which similar reference numerals are used throughout the description to describe similar features of the invention, FIG. 1 illustrates the cap or closure 2 of the present invention disposed on a container 10. Container 10 includes a main body portion 12 adapted to contain a fluid or solid substance and a neck portion 14 (shown in phantom) which defines an opening 16. Main body portion 12 is generally circular in horizontal cross-section except for two oppositely disposed panels 18. Panels 18 assist the user in handling the container. For example, the fingers of the hand may be positioned on one panel of the container while the thumb may be positioned on the opposite panel. Panels 18 are preferably flat so that the contents of the container may be properly mixed, for example, by swirling the contents against the inner surface of the container. Although panels 18 may be indented or recessed, these indentations could disrupt the mixing process and thus agitate the solution. If desired, graduation lines may be provided on the outer surface of panels 18.

The upper portion of main body 12 angles inwardly (at approximately 30°) to form neck portion 14 which is of reduced diameter. The wall of the neck portion defines the opening 16 of the container. Although not shown in FIG. 1, the outer surface of the neck may be threaded to securingly engage with the cap of the present invention.

The diameter of the opening and neck should be large enough (at least 33 mm) to allow introduction of instruments, such as pipettes, into the container. Moreover, the opening should be large enough to allow unobstructed pouring of the contents from the container. The diameter, length and thickness of the main body portion may be of any dimension and may be sized in accordance with the specific contents of the container. The container is preferably formed from glass or a sterilizable plastic, such as polyethylene terephthalate, and is preferably blow-molded. It should be realized by those skilled in the art, however, that any sterilizable, moldable material may be used to form container 10.

Disposed over opening 16 and neck 14 of container 10 is the cap or closure of the present invention. The closure of the present invention is unique in that it allows the user to comfortably hold the closure and container with one hand, thereby leaving the other hand free to perform other functions.

Figure 2:
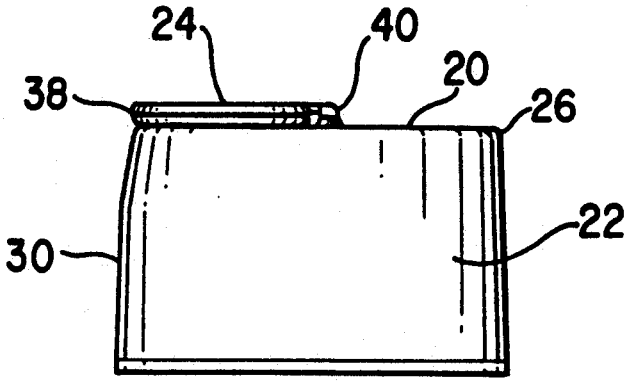
FIG. 2 is a left side elevational view of the closure shown in FIG. 1.

With reference to FIG. 2, closure 2 of the present invention generally includes a top surface 20, an apron 22 and a grasping tab 24. Closure 2 is preferably injection molded from a sterilizable material, such as polypropylene. However, those skilled in the art should note that other materials capable of undergoing sterilization techniques and other molding methods may also be utilized.

Figure 4:
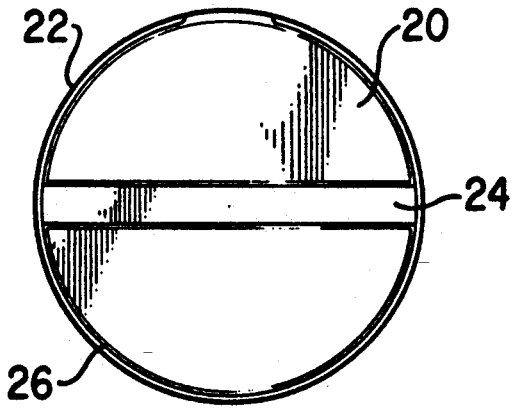
FIG. 4 is a top plan view thereof.

Top surface 20 of closure 2 is substantially flat or planar. It is perpendicular to the longitudinal axis of container 10 and devoid of any openings or apertures (see FIG. 4). The top surface terminates at a peripheral edge 26 which is generally circular in shape.

Figure 5:
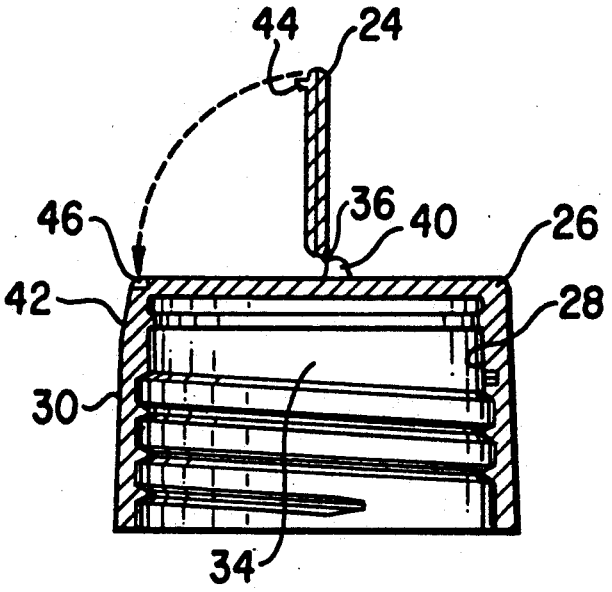
FIG. 5 is a cross-section view thereof.
Figure 6:
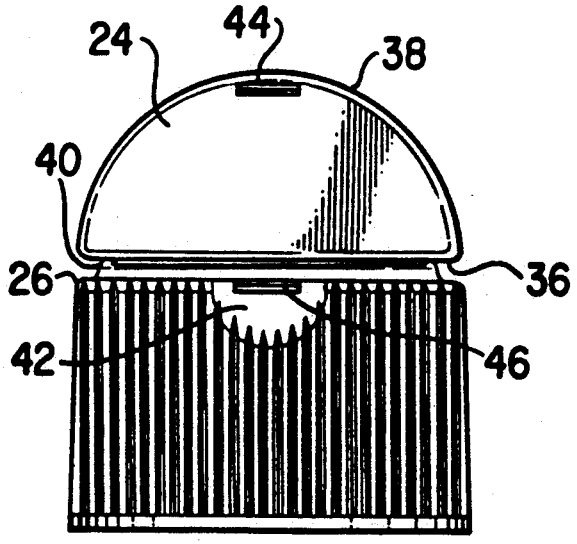
FIG. 6 is a front elevational view thereof.

Extending downwardly about peripheral edge 26 of top surface 20 is an apron 22. Apron 22 has a thickness which defines an inner surface 28 (see FIG. 5) and an outer surface 30. Inner surface 28 may be threaded to mate with the threaded outer surface of the container neck 14 to lockingly seal the closure about the opening of the container. Alternatively, the neck of the container may be provided with a lip which lockingly mates with a latching rim provided on inner surface 28 to seal the closure about the container.

Figure 3:
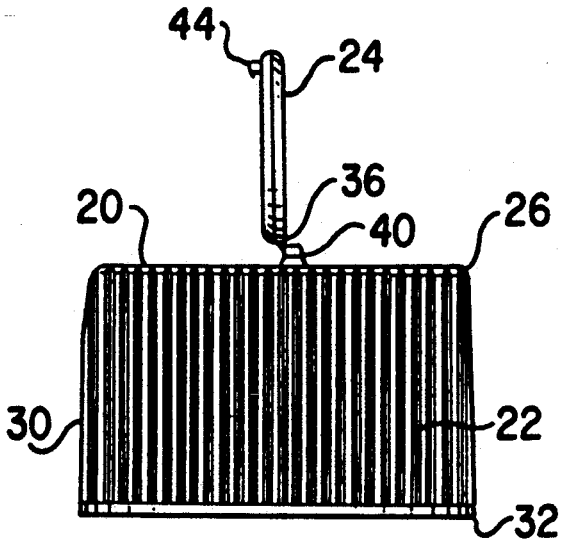
FIG. 3 is a left side elevational view of an alternate embodiment of the closure with the grasping tab in the extended position.

As shown in FIG. 3, for example, outer surface 30 of apron 22 may be vertically ribbed to provide increased frictional engagement between the closure and the user's hand. Apron 22 is parallel to the longitudinal axis of the container and is substantially circular in horizontal cross-section. It extends from the peripheral edge of the top surface and terminates at a lower edge 32.

Together, the top surface and apron of the closure define therebetween an interior area 34 which securingly receives the opening of container 10.

Attached to top surface 20 is a grasping tab 24 which enables the user to grasp and hold the closure between his or her fingers. Grasping tab 24, which is generally semi-circular in shape, is defined by an inner edge 36 and an arcuate outer edge 38. The outer edge of the grasping tab overlies or is aligned with peripheral edge 26 of top surface 20. The tab is attached at its inner edge to top surface 20 by a living hinge 40. Hinge 40 allows grasping tab 24 to be positionable between an extended or up condition perpendicular to top surface 20 (shown in FIGS. 3, 4, 5, 6 and 7) and a stored or down condition substantially flush with top surface 20 (shown in FIGS. 1, 2, 8 and 9). Although a living hinge is preferable for ease of manufacturing, it should be realized by those skilled in the art that any type of mechanical hinge may be employed which permanently attaches grasping tab 24 to top surface 20. In the preferred embodiment, inner edge 36 intersects the locus of top surface 20. However, the central width of the grasping tab may be greater or less than the radius of the top surface. Furthermore, although the grasping tab has been illustrated as semi-circular, it should be apparent that the tab may take any shape which allows it to be easily grasped between the fingers.

Provided at the upper edge of apron 22 is an indentation 42 which assists the user in positioning the grasping tab in the extended position. The indentation is molded within the outer surface of the apron at an angle of approximately 12°. It is substantially u-shaped (see FIG. 6). The indentation allows the thumb of the user to contact the underside of the grasping tab to lift and position the same in the extended condition.

The closure of the present invention may be further provided with a locking means to secure the grasping tab in the stored condition when the grasping tab is not in use. In one embodiment of the invention, a latch 44 (which extends from the outer edge of the tab) and a corresponding lip 46 (which projects from the indentation of the apron) is provided. When the grasping tab is pushed completely down, latch 44 snaps beneath lip 46 to lock the tab in the stored condition. The tab may be easily unlocked (and positioned in the extended condition) by placing the thumb within indentation 42 and lifting up on the underside of the tab.

Figure 7:
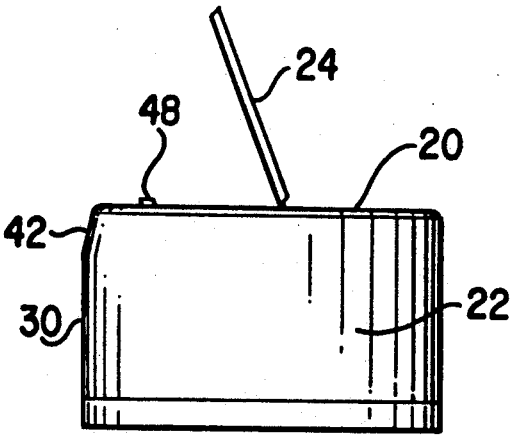
FIG. 7 is an alternate embodiment of the closure of the present invention.
Figure 8:
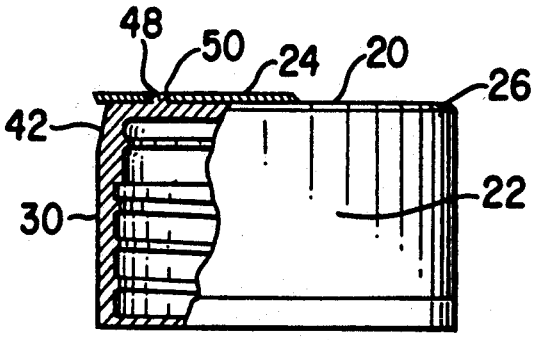
FIG. 8 is a partial cross-section view thereof.
Figure 9:
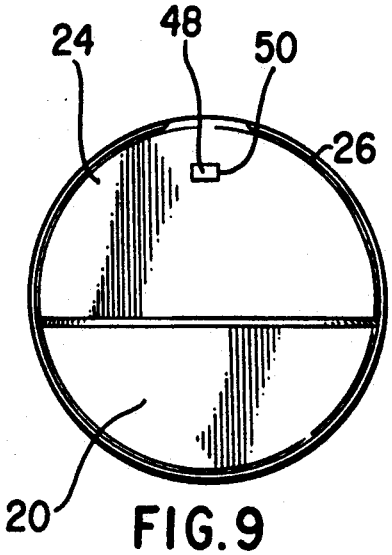
FIG. 9 is a top plan view thereof.

FIGS. 7–9 illustrate an alternative locking means which includes a locking tab 48 and a tab-receiving opening 50. The locking tab is disposed on the top surface of the closure and is received within the tab-receiving opening defined by the grasping tab to lock the grasping tab in the stored condition. Other locking means, although not specifically discussed herein, may be employed to lock the grasping tab in the stored condition.

Naturally, the closure of the present invention will be dimensioned in accordance with the opening and neck of the container.

Figure 10:
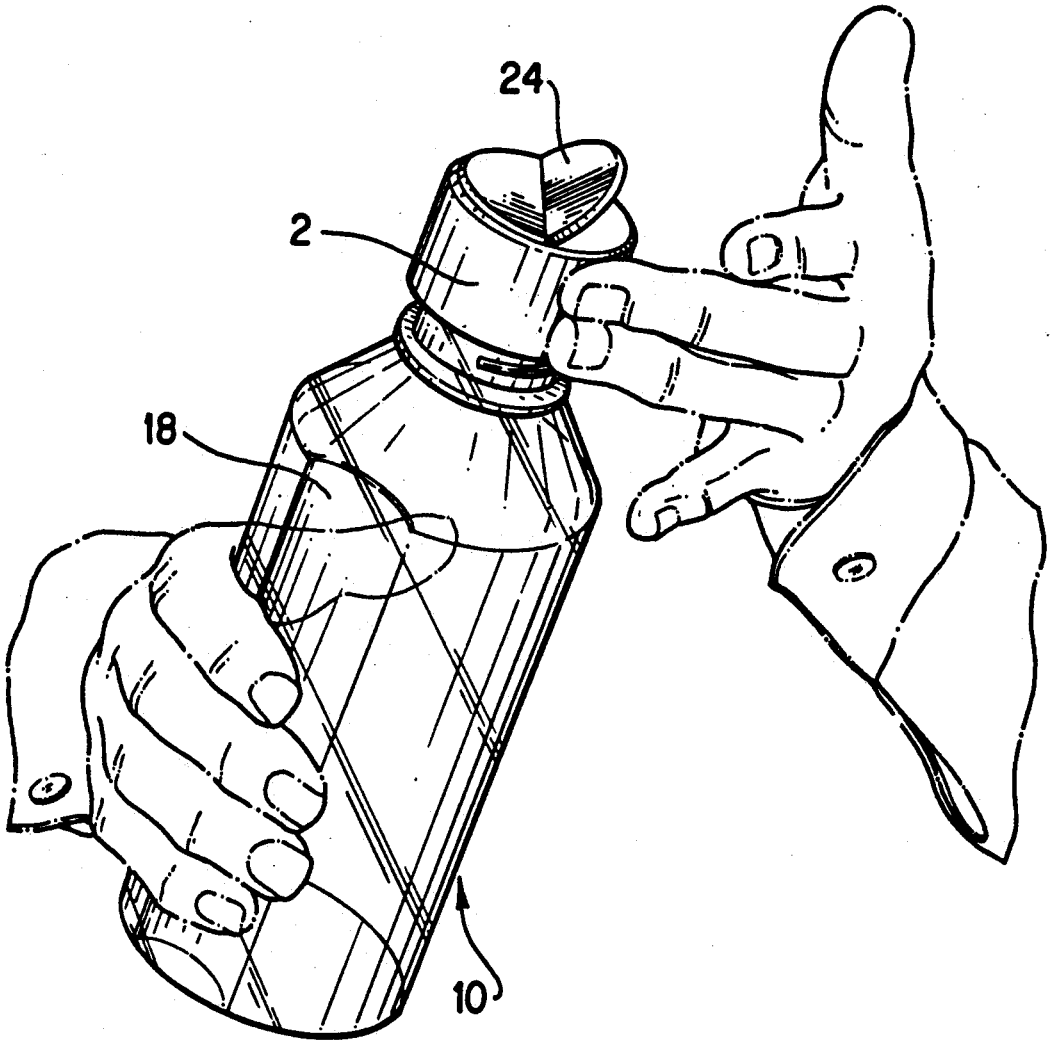
FIG. 10 illustrates the closure of the present invention utilized in its intended environment.
Figure 11:
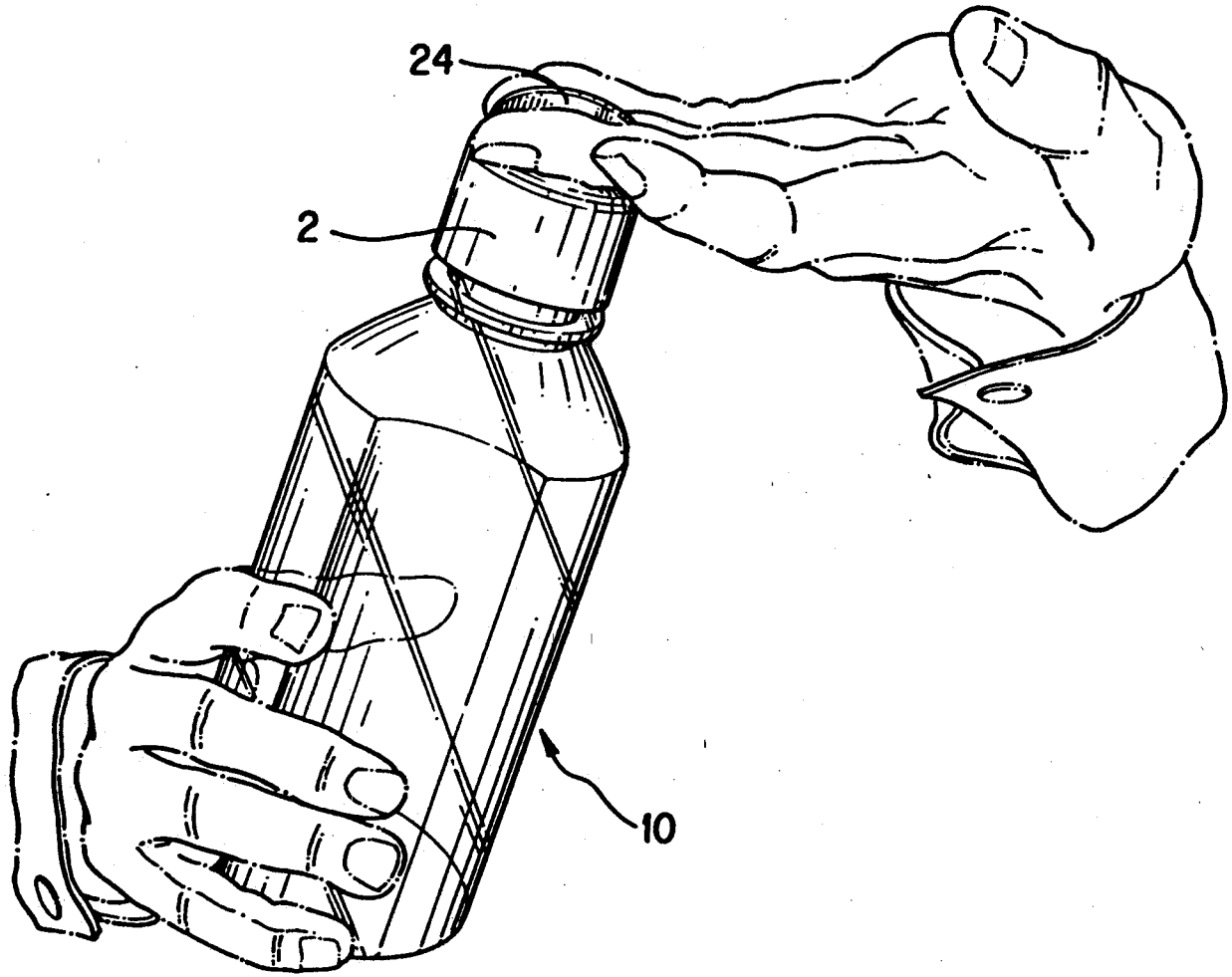
FIG. 11 illustrates the grasping tab of the closure grasped by the fingers of a user.
Figure 12:
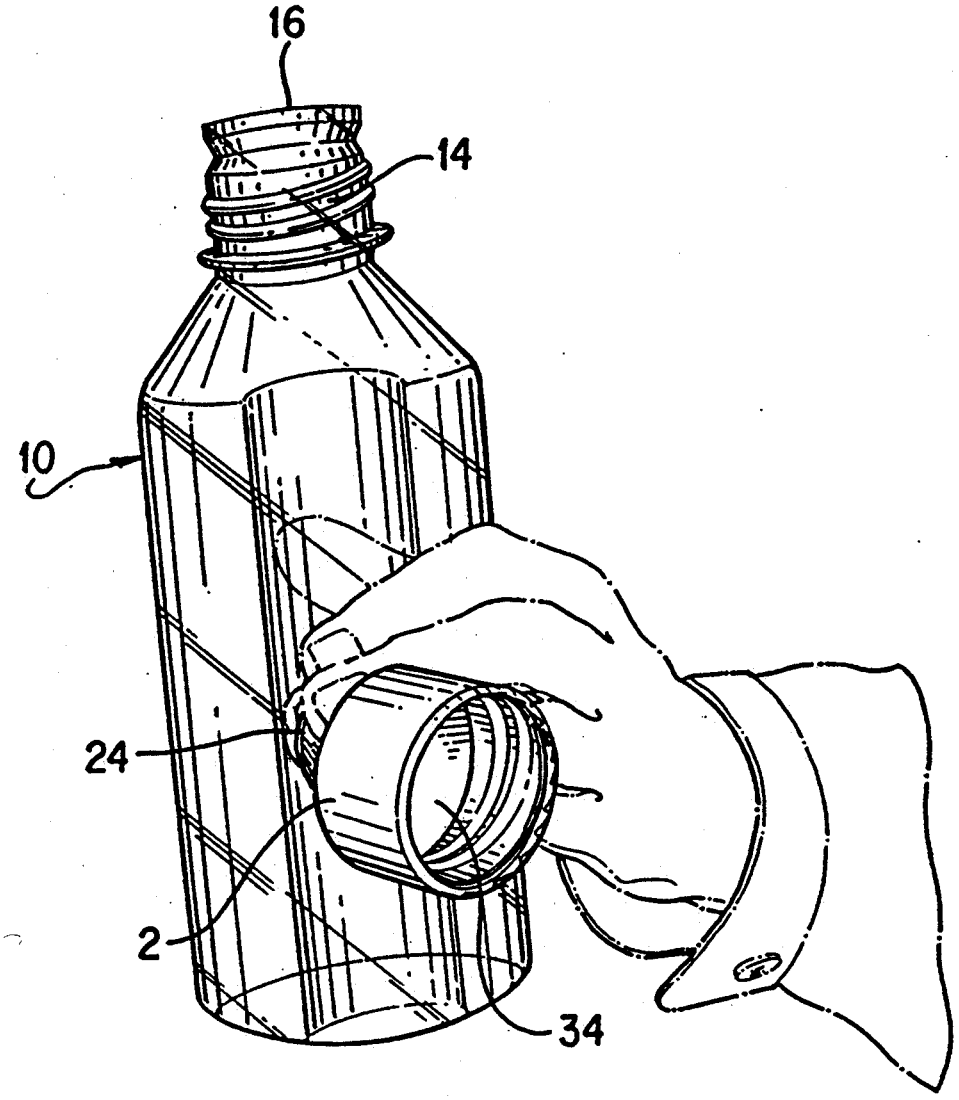
FIG. 12 illustrates grasping of the grasping tab and holding of the container with one hand of the user.

Having discussed the structural components of the present invention, the use of the closure will now be described. With reference now to FIGS. 10–12, the closure of the present invention is shown disposed on a container 10. In use, the container is held in one hand with the fingers of the hand resting on one of the flat panels 18 and the thumb of the hand resting on the other oppositely disposed panel. To remove the closure, the thumb of the user's free hand is placed within the indentation of the apron and wedged against the underside of the grasping tab. The thumb is used to apply a force to the underside of the grasping tab to lift the same and position the tab in the extended condition. The user then grasps the apron of the closure with his free hand and unscrews the closure from the opening of the container, but does not remove the closure therefrom (see FIG. 10). The vertical ribs provided on the outer surface of the apron allow the user to easily grip the apron of the closure. The user then grasps the extended grasping tab between the fingers of his free hand with the palm of the free hand facing up (see FIG. 11). Thus, the top surface of the closure rests against the back side of the fingers and the palm faces up. The closure is then removed from the container by lifting up the hand. The palm of the hand with the grasping tab positioned between the fingers is then placed around the body portion of the container to hold the same. The fingers and thumb of the hand rest upon the oppositely disposed panels (see FIG. 12). The user's other hand is now free to hold other containers (such as beakers or test tubes) or remove solution from the container via a pipette. Thus, the grasping tab of the closure allows the user to easily and comfortably hold the container and closure with the same hand to prevent contamination of the closure which would otherwise occur if the closure were to be placed on an unsterile surface. Furthermore, the ability to hold the closure and container in the same hand allows the user to use his free hand for other purposes.

When the user is finished pouring (or pipetting) from the container, the opening and neck of the container are sterilized (by flaming, for example) to destroy air-borne bacteria which may have come into contact with the container to contaminate the same. Following sterilization of the container, the user replaces the closure by placing the closure over the opening of the container and screwing the closure onto the neck of the container. The grasping tab is then positioned in the stored condition (by pushing down on the tab) so that the tab does not interfere with shelving or storage of the container. The grasping tab is locked into the stored condition by pushing down on the tab until the locking latch snaps beneath the lip (or the locking tab is received within the tab-receiving opening).

The present invention which is intended to be protected herein should not be construed as limited to the particular forms disclosed, as these are to be regarded as illustrative rather than restrictive. Variations and changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. A container, comprising:

a main body portion;

neck portion which defines an opening; and a closure including:

(a) a top surface having a peripheral edge, said top surface being devoid of an opening;

(b) a downwardly extending apron having an inner surface and an outer surface arranged about said peripheral edge of said top surface, said top surface and said apron defining therebetween an interior area adapted to receive the opening of the container;

(c) a grasping tab which allows said tab of said closure to be grasped by the fingers of the user, said tab being attached to said closure across the diameter of said top surface by a hinge such that said tab selectively extends upwardly from and substantially perpendicular to the top surface of said closure, and such that said tab may be further selectively positioned in a stored condition wherein said tab is substantially flush with said top surface when said tab is positioned in said stored condition; and (d) an indentation provided within the outer surface of said apron to assist in selectively extending said tab from said top surface of said closure.

2. The container of claim 1, wherein the inner surface of said apron is threaded.

3. The container of claim 1, wherein the closure further comprises a locking means for locking the grasping tab in the stored condition.

4. The container of claim 1, wherein the closure is formed from a sterilizable plastic.

5. The container of claim 4, wherein the plastic is polypropylene.

6. The container of claim 1, wherein the outer surface of said apron of said closure is vertically ribbed.

7. The container of claim 3, wherein said locking means of said closure includes a tab and a tab-receiving aperture.

8. A closure for a container, comprising:

a top surface having a peripheral edge, said top surface being devoid of an opening;

an apron having an inner surface and an outer surface which extends downwardly from the peripheral edge of the top surface, said top surface and said apron defining therebetween an interior area adapted to receive the opening of a container;

a grasping tab, having a substantially continuous grasping surface which allows said tab to be easily grasped and held between the user's fingers, hinged attached to said top surface such that said grasping tab is positionable between an extended condition perpendicular to said top surface and a stored condition such that said tab occupies a substantial area of said top surface when said tab is positioned said stored condition; and an indentation provided within the outer surface of said apron to assist in positioning said grasping tab in said extended condition.

9. The closure of claim 8, wherein the inner surface of said apron is threaded.

10. The closure of claim 8, wherein the closure further comprises a locking means for locking said grasping tab in the stored condition.

11. The closure of claim 8, wherein the closure is formed from a sterilizable plastic.

12. The closure of claim 11, wherein said plastic is polypropylene.

13. The closure of claim 8, wherein the outer surface of said apron is vertically ribbed.

14. The closure of claim 10, wherein said locking means comprises a tab and a complementary tab-receiving aperture.

* * * * *